United States Patent [19]

Adler

[11] 4,103,935

[45] Aug. 1, 1978

[54] ACCOUNTS RECEIVABLE SYSTEM

[75] Inventor: Arnold Henry Adler, Penfield, N.Y.

[73] Assignee: Burroughs Corporation, Detroit, Mich.

[21] Appl. No.: 803,482

[22] Filed: Jun. 6, 1977

[51] Int. Cl.[2] ..... B42D 12/02

[52] U.S. Cl. ..... 283/66 R

[58] Field of Search ..... 283/66 R, 66 A, 63 H, 283/61

[56] References Cited

U.S. PATENT DOCUMENTS 1,604,572 10/1926 Hauseer ..... 283/66 R

*Primary Examiner*—J. M. Meister

*Attorney, Agent, or Firm*—Kevin R. Peterson; Lynn L. Augspurger

[57] ABSTRACT

Disclosed is an accounts receivable system of the pegboard or accounting board type, and specifically, one which uses a ledger which has a hectograph-carbon stencil for the transfer of the name and address of the customer to a statement and a statement for receiving the address as the image is transferred from the ledger to the surface of the statement, utilizing a film of hectograph fluid.

4 Claims, 6 Drawing Figures

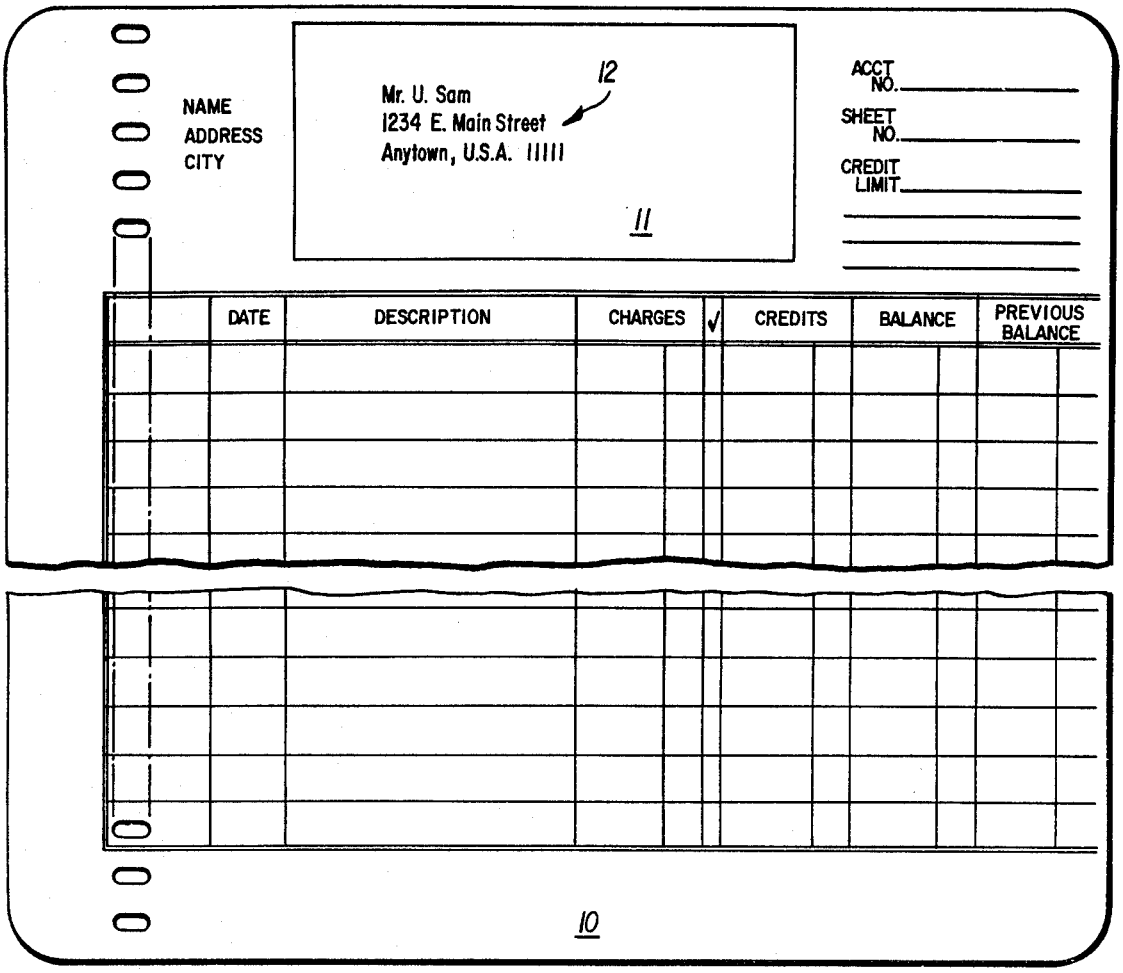
FIG. 1 PRIOR ART
FIG. 2 PRIOR ART
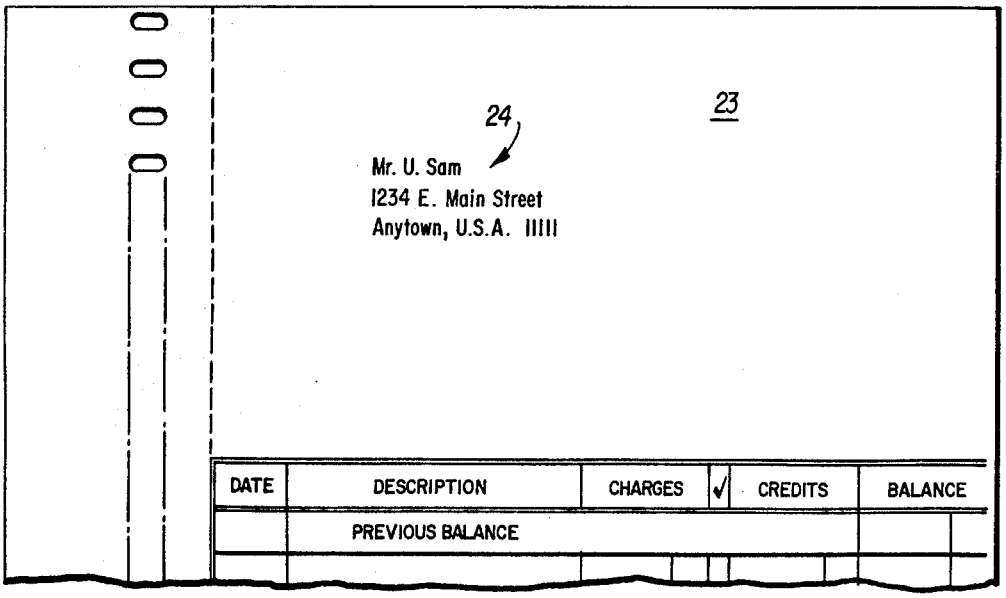

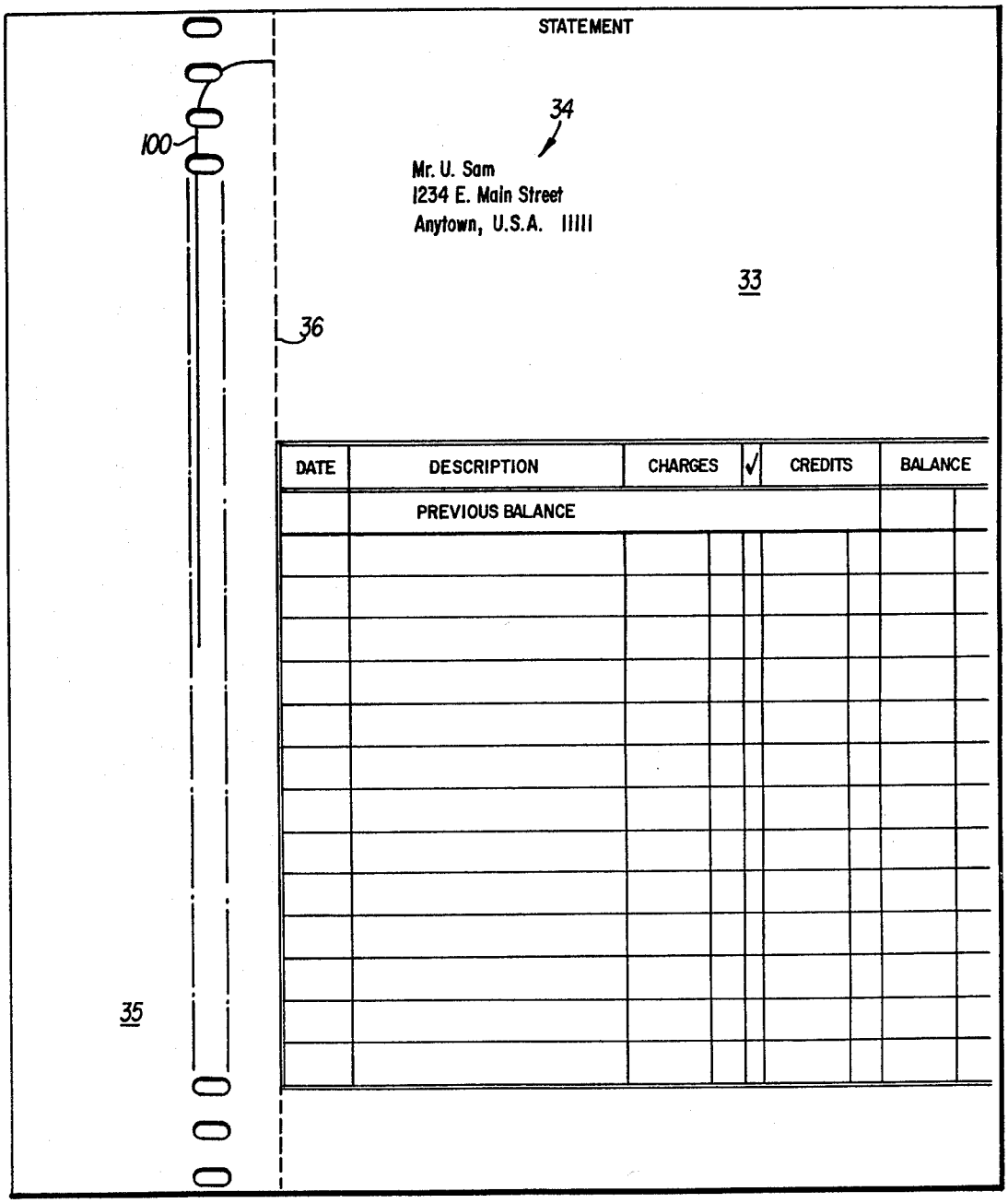
FIG. 3
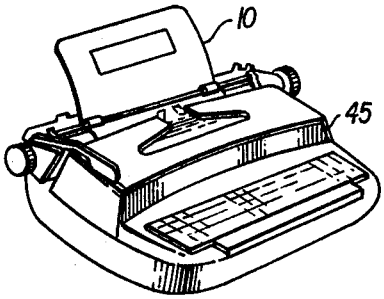
FIG. 4
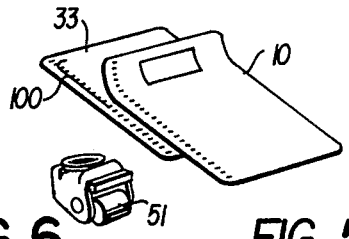
FIG. 6
FIG. 5

ACCOUNTS RECEIVABLE SYSTEM

BACKGROUND OF THE INVENTION

This invention relates to accounts receivable systems and especially to an improved system having a ledger and statement for receiving a hectograph-carbon transfer of the address from the ledger.

It is a common process with hand-posted accounts receivable systems utilized in a pegboard system to die cut the ledger, affix a piece of paper thereto which will serve as a stencil, and then use a hectograph-carbon to make a stencil that will transfer the image of the name and address from the ledger stencil to the statement. A small hand-addressor is used to transfer to the surface of the statement a film of hectograph fluid.

The problem with this prior art is that the process of positioning the ledger on the statement is a time-consuming one, and the user must look under the ledger to position the letters on the stencil over the area of the statement where they will appear after transfer if they are to be aligned at the proper position on the statement.

SUMMARY OF THE INVENTION

My improvement to the system is to match the ledger with the statement by preprinting a line in the margin of the statement in the initial printing of the statement which margin line guides the user so that he does not have to look under the ledger to position the letters on the stencil over the area of the statement where the letters will appear after transfer.

It is an important feature of my improvement that the margin guideline have a curvature matching the edge of the ledger at the upper left-hand corner of the ledger and having a lineal downward extent down the side from the corner on the statement which approximates one-half the length of the statement and have a traverse extent from the corner which is less than or equal to the distance to a tear perforation which is a vertical separation line for separating the statement from the pegboard guide strip.

For further understanding of my invention and the interaction of the statement and the ledger, reference will be made to the accompanying drawings in which:

FIG. 1 is a plan view of a ledger card utilized in both the prior art and with my invention; and FIG. 2 is a specimen of the prior art statement; and FIG. 3 is a specimen statement incorporating the features of my invention; and FIG. 4 is a figure illustrating the preparation of the ledger; and FIG. 5 is a view of the ledger and statement in accordance with my invention shown as they would be in the process of being removed after transfer utilizing a hand-addressor.

FIG. 6 is a view of the hand-addressor.

Turning now to my invention in greater detail, it will be seen that the ledger card 10 bears a hectographcarbon stencil insert 11 at the top thereof. An address of a customer 12 may be typed thereon using a hectograph-carbon stencil tab for transfer of carbon to the back of the ledger. This may be done with an ordinary typewriter 45, as seen in FIG. 4.

A small hand-addressor 51 (See FIG. 5) is used to wet the surface of the statement at the area indicated by 24 in FIG. 2. The statement 23 is readied for transfer of the address shown in FIG. 2 at 24 by rolling the addressor 51 against the stencil 11 as it is positioned over the wet area of the statement 23. As the prior art, FIG. 2, has a statement without any guide, this is difficult and time-consuming in order to accomplish address transfer without my improvement. The user must look under the ledger to position the letters on the stencil over the area of the statement where the letters will appear in the window after the application of pressure to the stencil.

In accordance with my improvement, the statement is preprinted with a guideline margin 100 matching that of the upper left-hand edge of the mating ledger so that the upper left-hand corner of the ledger fits perfectly with the printed margin guideline. I prefer that the vertical extent of the margin guideline 100 end at the approximate mid-point of the statement form.

The horizontal extent of the preprinted margin guideline 100 will end at a vertically-aligned separation perforation 36 which separates the right-hand statement 33 from the left-hand perforation tear strip 35.

In accordance with my invention, the line which is used as a margin guideline 100 is preprinted with the statement itself. The ledger which has received an address in an ordinary typewriter 45 using a hectograph-carbon is used in connection with the improved statement. The improved statement 33 is laid on a flat surface and a film of hectograph fluid is applied utilizing the hand-addressor 51. Then the ledger is positioned over the statement so that the upper left-hand corner of the ledger fits into the printed margin guideline 100 and a roller on the hand-addressor is rolled across the stencil 11 and pressure exerted with the roller on the ledger so that the address image will be transferred to the statement. Thereafter, the ledger 10 is lifted from the statement 33 as seen in FIG. 5 and the ledger will be aligned on the pegboard and thereafter the statement will be aligned on the pegboard at the proper position over the ledger. Such entries will be made as are required by the transaction and then the statement separated from the tear strip 35 for mailing.

Various modifications and improvements will occur to those skilled in the art both now and in the future after reviewing the foregoing description of my invention. This modification is contemplated and expected after a review of this disclosure. The scope of my invention is to be interpreted in accordance with the appended claims.

I claim:

1. An accounts receivable system having a ledger card and a statement for use with a pegboard, said ledger having alignment perforations for mounting the ledger on the pegboard, and said statement also having alignment perforations for mounting the statement on the pegboard over the ledger, both the ledger and the statement being printed with entry points for various entries to be made representing a transaction, such transactions to be posted to the ledger concurrently with the posting on the statement, the said ledger also bearing a stencil at the top thereof positioned so that an address entered thereon may conform to the position of an address used in a standard window envelope, and the statement bearing a marginal guideline corresponding to the upper left-hand corner of the ledger so that the ledger can be fitted into the marginal guideline to transfer an address entered on the stencil of the mating ledger to the statement by stencil transfer.

2. The accounts receivable system according to claim 1 wherein the statement has a perforation line which extends vertically along its length for separating a statement portion from a tear strip defined by the perforation line.

3. The accounts receivable system according to claim 1 wherein the statement bears a marginal guideline which extends vertically downward from the top of the statement and ends at approximately the mid-point of the statement.

4. An accounts receivable system according to claim 3 wherein the horizontal extent of the marginal guideline ends at the perforation line of the statement, which perforation line extends the vertical length of the form and is utilized to separate the statement from an edge side tear strip.

* * * * *